US011780715B2

(12) United States Patent
Whaley et al.

(10) Patent No.: US 11,780,715 B2
(45) Date of Patent: Oct. 10, 2023

(54) HOIST BRAKE

(71) Applicant: Wenger Corporation, Owatonna, MN (US)

(72) Inventors: Christopher D. Whaley, Phoenix, NY (US); Alvah B. Aldrich, Geneva, NY (US); Maximilian J. Sauer, Rochester, NY (US); Peter V. Svitavsky, Port Byron, NY (US)

(73) Assignee: Wenger Corporation, Owatonna, MN (US)

( * ) Notice: Subject to any disclaimer, the term of this patent is extended or adjusted under 35 U.S.C. 154(b) by 495 days.

(21) Appl. No.: 16/820,134

(22) Filed: Mar. 16, 2020

(65) Prior Publication Data

US 2021/0284510 A1 Sep. 16, 2021

(51) Int. Cl.
*B66D 5/14* (2006.01)

(52) U.S. Cl.
CPC ..... *B66D 5/14* (2013.01)

(58) Field of Classification Search
CPC .. B66D 5/02; B66D 5/14; F16D 59/02; F16D 2121/26
USPC ..... 188/171
See application file for complete search history.

(56) References Cited

U.S. PATENT DOCUMENTS 1,864,588 A 6/1932 Dunlop
3,628,221 A 12/1971 Pasbrig
3,776,586 A 12/1973 Ahlgren et al.
4,177,973 A * 12/1979 Miller ..... B66D 5/30 188/170
4,397,253 A 8/1983 Uecker
4,493,479 A * 1/1985 Clark ..... B66D 5/24 188/134
4,620,499 A 11/1986 Slemmons
5,149,242 A * 9/1992 Haymore ..... B66F 9/07 254/323
6,092,789 A * 7/2000 Christopher ..... B66D 5/26 254/377
6,223,868 B1 5/2001 Wallimann
7,591,351 B2 * 9/2009 Fischer ..... B66D 5/14 188/164
7,699,145 B2 * 4/2010 Ericson ..... B66D 5/30 187/250
8,256,579 B2 9/2012 Jia
8,317,159 B2 * 11/2012 Hoffend, III ..... F16M 13/022 160/331
8,973,717 B2 3/2015 Bae
9,061,869 B2 * 6/2015 Hoffend, III ..... A63J 1/028
10,214,382 B2 * 2/2019 Wei ..... F16F 15/002
2006/0090969 A1 5/2006 Eckenstein et al.
2009/0127527 A1 * 5/2009 Hoffend, III ..... B66D 1/74 242/615

(Continued)

FOREIGN PATENT DOCUMENTS

DE 20217287 U1 * 3/2003 ..... B66B 11/0476
EP 0570859 A1 * 11/1993 ..... B66D 5/14

*Primary Examiner* — Thomas W Irvin
(74) *Attorney, Agent, or Firm* — Patterson Thuente, P.A.

(57) ABSTRACT

A hoist brake system is disclosed. The brake system incorporates an electro-mechanical device that acts as a fail-safe stopping mechanism for a hoist and has a default engaged. This allows the brake system to quickly and safely stop a device when power is lost, an emergency signal is provided or any other fault condition and be completely self-contained within the hoist itself.

19 Claims, 16 Drawing Sheets

(56) References Cited

U.S. PATENT DOCUMENTS

| | | | | |
|---|---|---|---|---|
| 2009/0218182 | A1* | 9/2009 | Klingler | F16D 59/02 188/171 |
| 2011/0198167 | A1* | 8/2011 | Huppunen | F16D 65/14 188/171 |
| 2012/0017400 | A1 | 1/2012 | Ussher | |
| 2013/0015315 | A1* | 1/2013 | Hoffend, III | B66D 1/56 248/542 |
| 2016/0377150 | A1 | 12/2016 | Simonson et al. | |
| 2019/0382240 | A1* | 12/2019 | Schaeuble, Jr. | B66D 5/30 |
| 2021/0284509 | A1* | 9/2021 | Whaley | B66D 1/48 |

* cited by examiner

HOIST BRAKE

TECHNICAL FIELD

The present invention relates to a brake system. Specifically, the present invention is a secondary braking system for use with a hoist.

BACKGROUND

The use of hoists for lifting and lowering items is well known. Known in the art are several mechanisms used in braking for a hoist. Some braking mechanisms apply friction directly to the hoist drum to slow/stop rotation of the drum. Another means of braking involves applying friction to the drive shaft of the hoist to slow/stop rotation. Braking of hoists may also be accomplished by applying friction directly to the hoist line.

A drawback of prior art hoist brakes is the need for early engagement of the brake device to stop the hoist line at a desired location. Another drawback of prior art hoist brakes is the need to manually adjust the brake system over time due to wear and alignment issues due to vibration and stresses on the hoist. Many prior art hoist brakes do not include built-in failsafe structures and require secondary emergency braking systems to deal with issues such as power loss. Prior art hoist brakes were directed at solving some of these issues, but in doing so either ignored other issues or exacerbated the other issues.

While prior art devices have attempted to address the various drawbacks of hoist brake systems, there still exists the need for improved performance of hoist brakes that also provides improved safety while also minimizing maintenance.

SUMMARY

An innovative brake system for use with a hoist assembly is disclosed. The brake system incorporates an electromechanical device that acts as a fail-safe stopping mechanism for a hoist (or analogous device) that has a default engaged (brake on) position. This allows the brake system to quickly and safely stop a device when power is lost, an emergency signal is provided or any other fault condition (over travel, control failure, drive train failure) and be completely self-contained within the hoist itself.

A spring biases a control arm to maintain the brake system in an engaged position, which applies a clamping force sufficient to prevent any further movement of the hoist (spooling or unspooling). The brake system only allows movement of the hoist under power and when signaled to allow movement. This secondary brake system responds within milliseconds to stop hoist movement within several inches, even at loads of 2,500-4,700 lbs.

During normal operation an embodiment, the electromechanical brake is opened is initiate movement through control signals from an independent microprocessor. The microprocessor controls the speed, current draw, and initial release speed of the opening drive system. The opening drive system provides force by taking advantage of an electrical motor which pulls against the torsion spring increasing the rotary torque being applied to the mechanical brake portion of the brake mechanism. Utilization of the microprocessor permits pin point control of the electrical motor, which reduces heat generation from the motor, current demands for the system, and allows increased speed control of the motor while activating the brake system.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
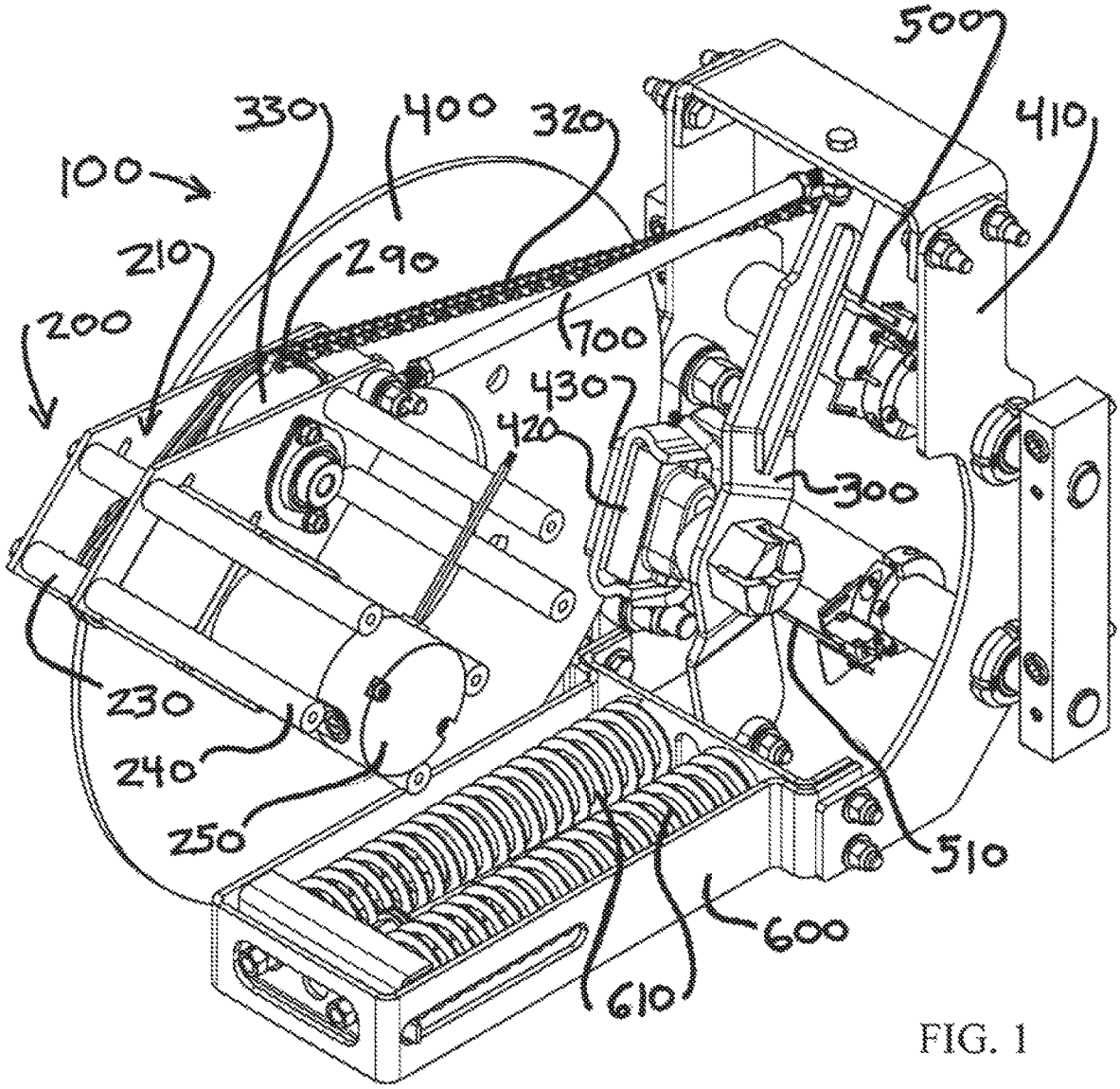
FIG. 1 is a front isometric view of brake system incorporating an embodiment of the invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Attached are drawings of an embodiment of the bucket tray of the present invention as well as detailed drawings of the individual components of the bucket tray. It is understood that the various components disclosed in the drawings may be substituted with equivalent components and are not considered limiting.

The following detailed description should be read with reference to the drawings in which similar elements in different drawings are numbered the same. The accompanying figures depict embodiments of the electro-mechanical brake system of the present invention, and features and components thereof. Any references to front and back, right and left, top and bottom, upper and lower, and horizontal and vertical are intended for convenience of description, not to limit the present invention or its components to any one positional or spatial orientation. The drawings, which are not necessarily to scale, depict illustrative embodiments and are also not intended to limit the scope of the invention. Any reference in the claims to a "hoist" is not intended to limit the scope of the invention to a specific type of hoist, but to any type of rotational lifting or pulling device including winches, cranes, lifts, etc.

Figure 17:
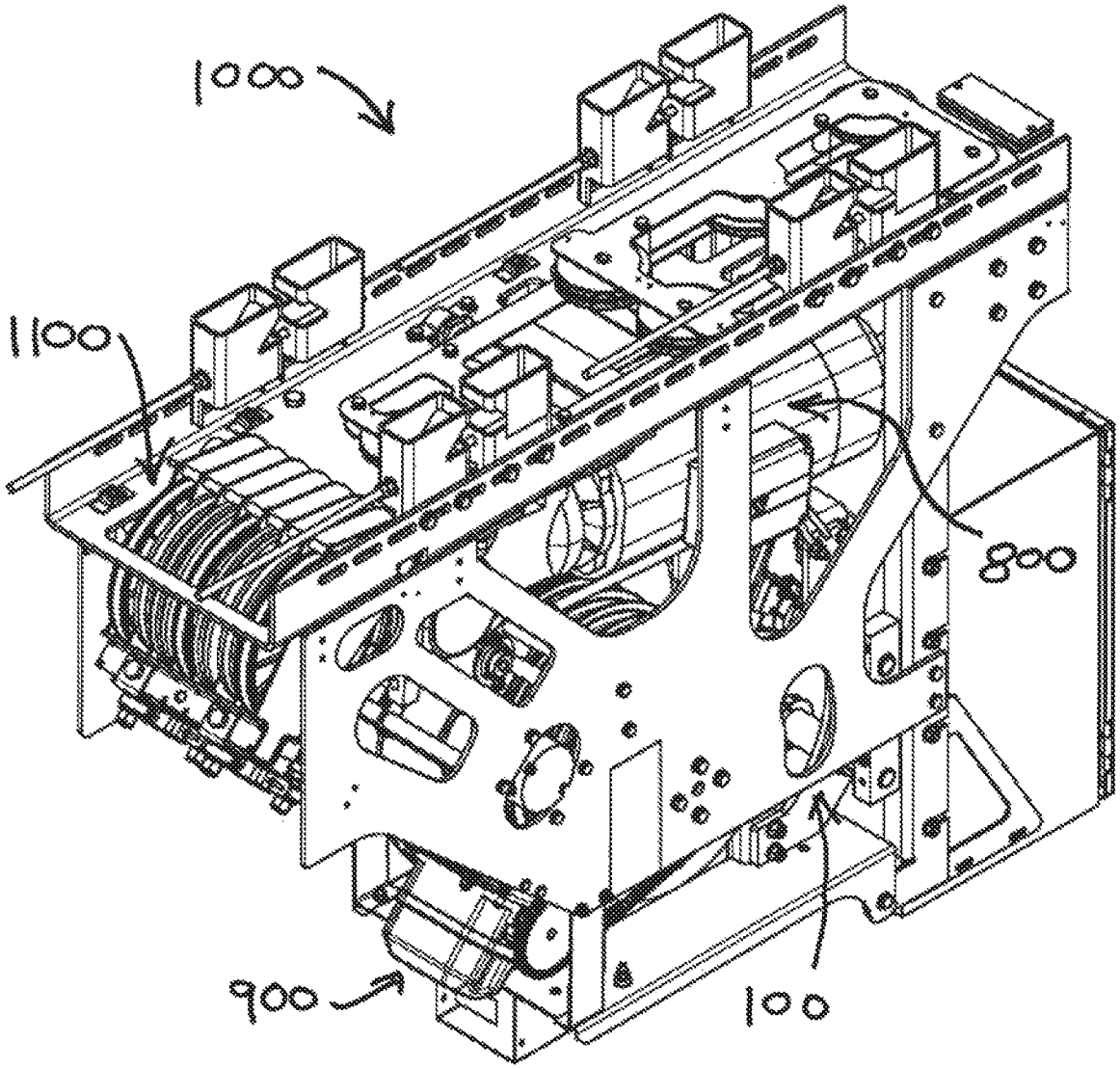
FIG. 17 is a front isometric view of a hoist system incorporating the hoist brake system of FIG. 1.
Figure 18:
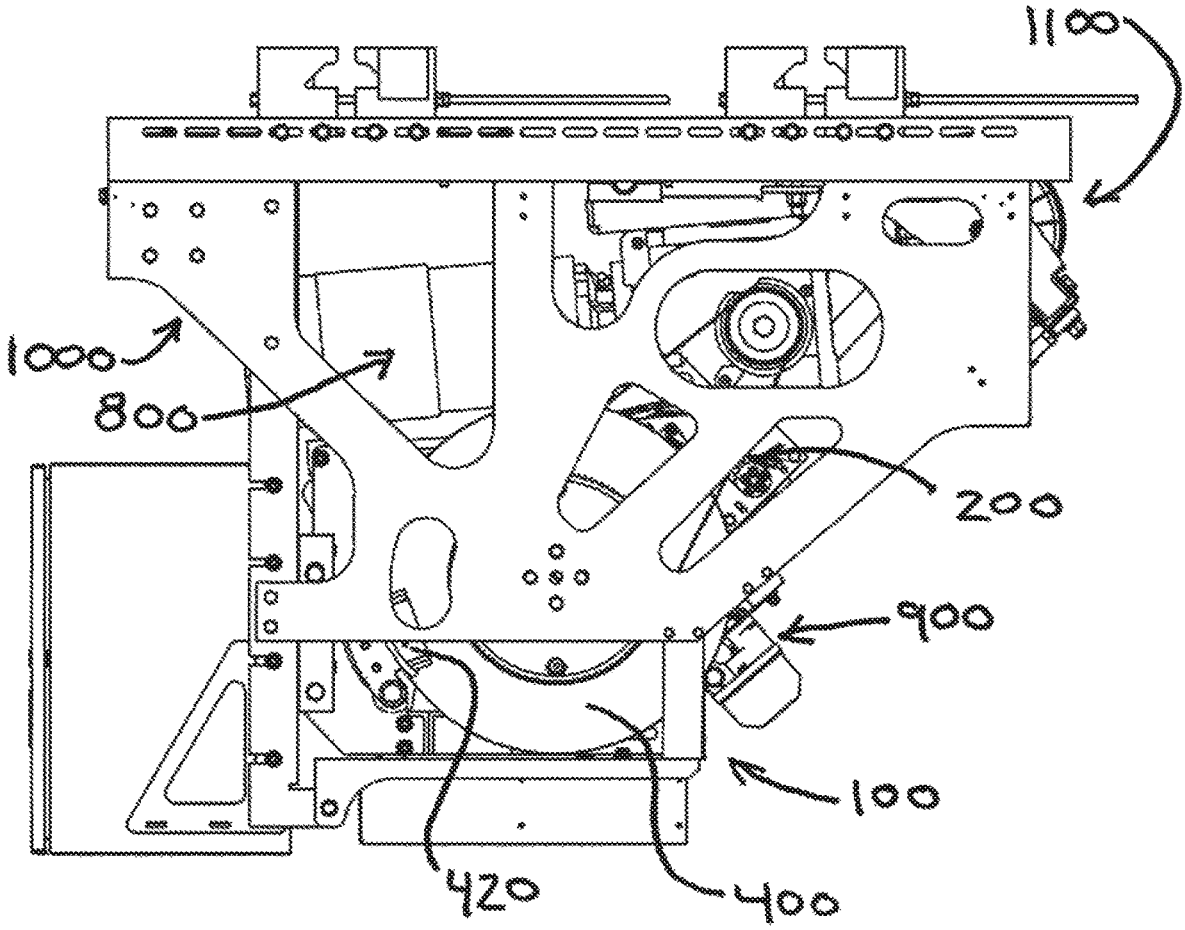
FIG. 18 is a rear elevation view of the hoist system of FIG. 17.

An electro-mechanical brake system according to an embodiment of the invention is depicted generally in FIGS. 1-18 by reference numeral 100. The electro-mechanical brake system 100 is a component of a hoist system 1000 (FIGS. 17-18) with other main components of a hoist system 1000 comprising a hoist drive system 800 and hoist fleet system 1100.

Figure 2:
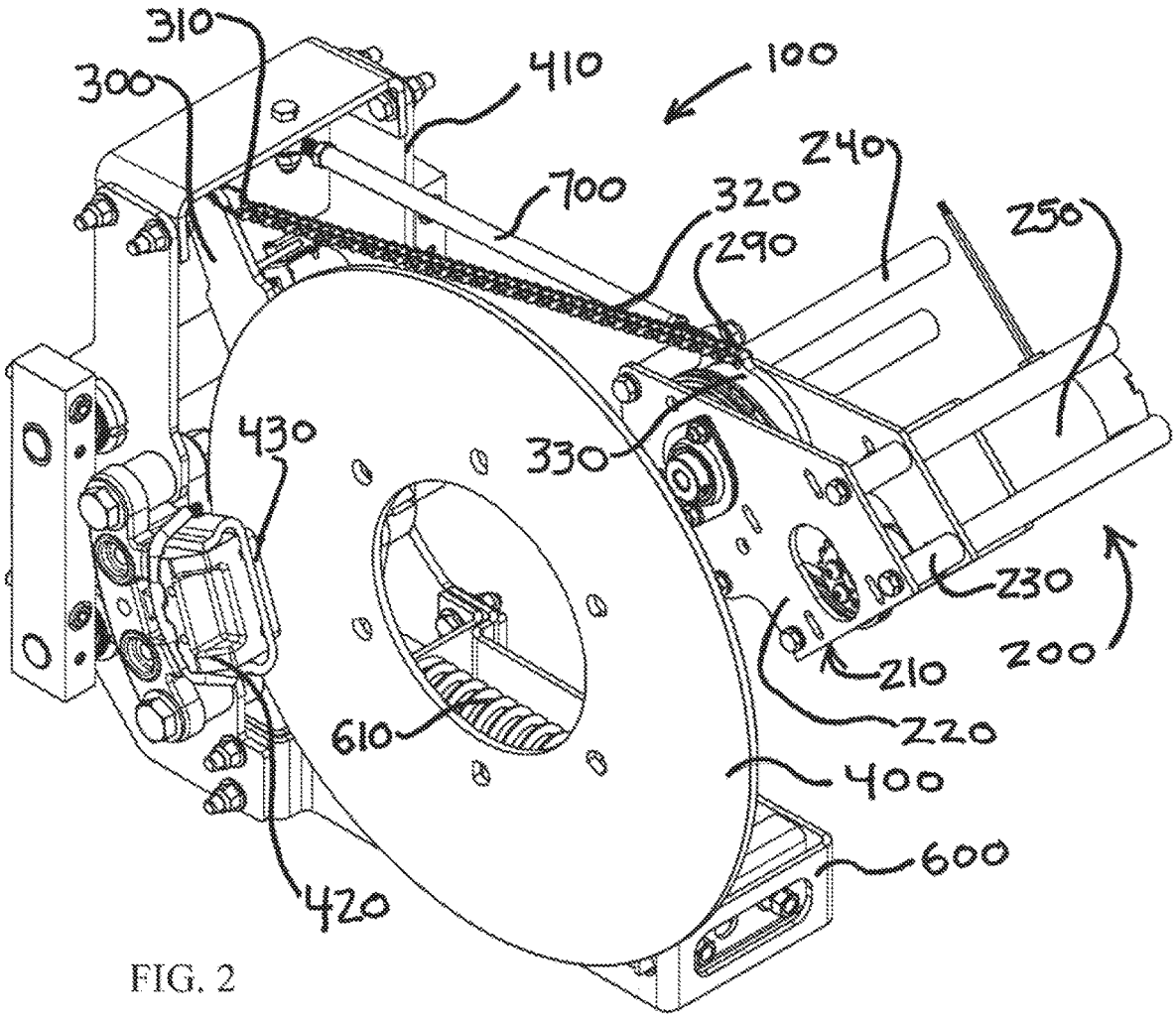
FIG. 2 is a rear isometric view of the brake system of FIG. 1.
Figure 3:
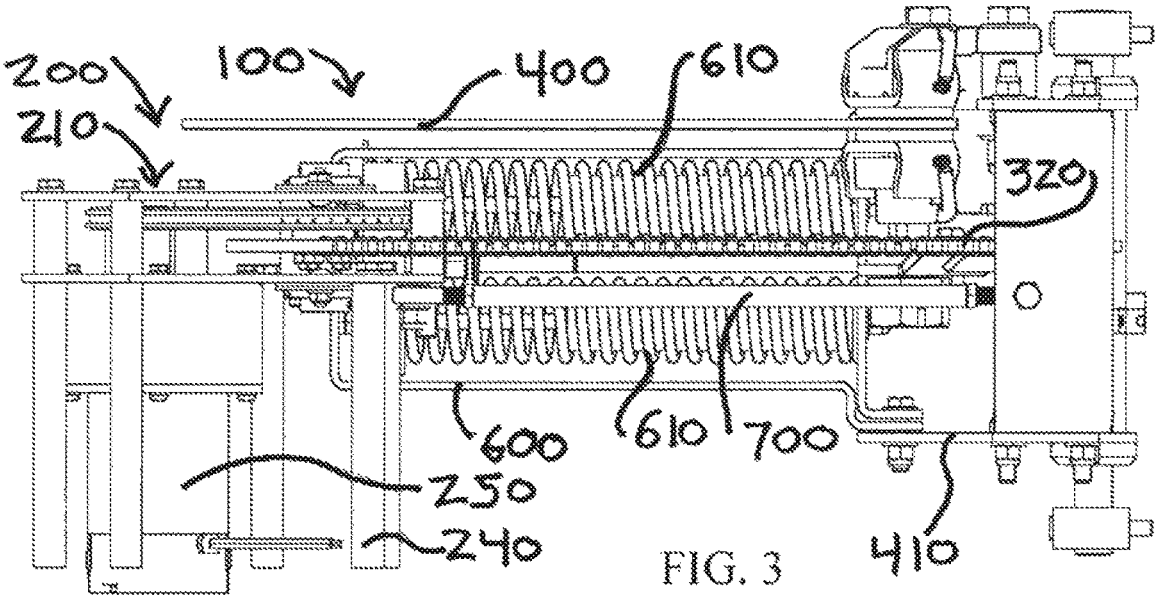
FIG. 3 is a top view of the brake system of FIG. 1.
Figure 4:
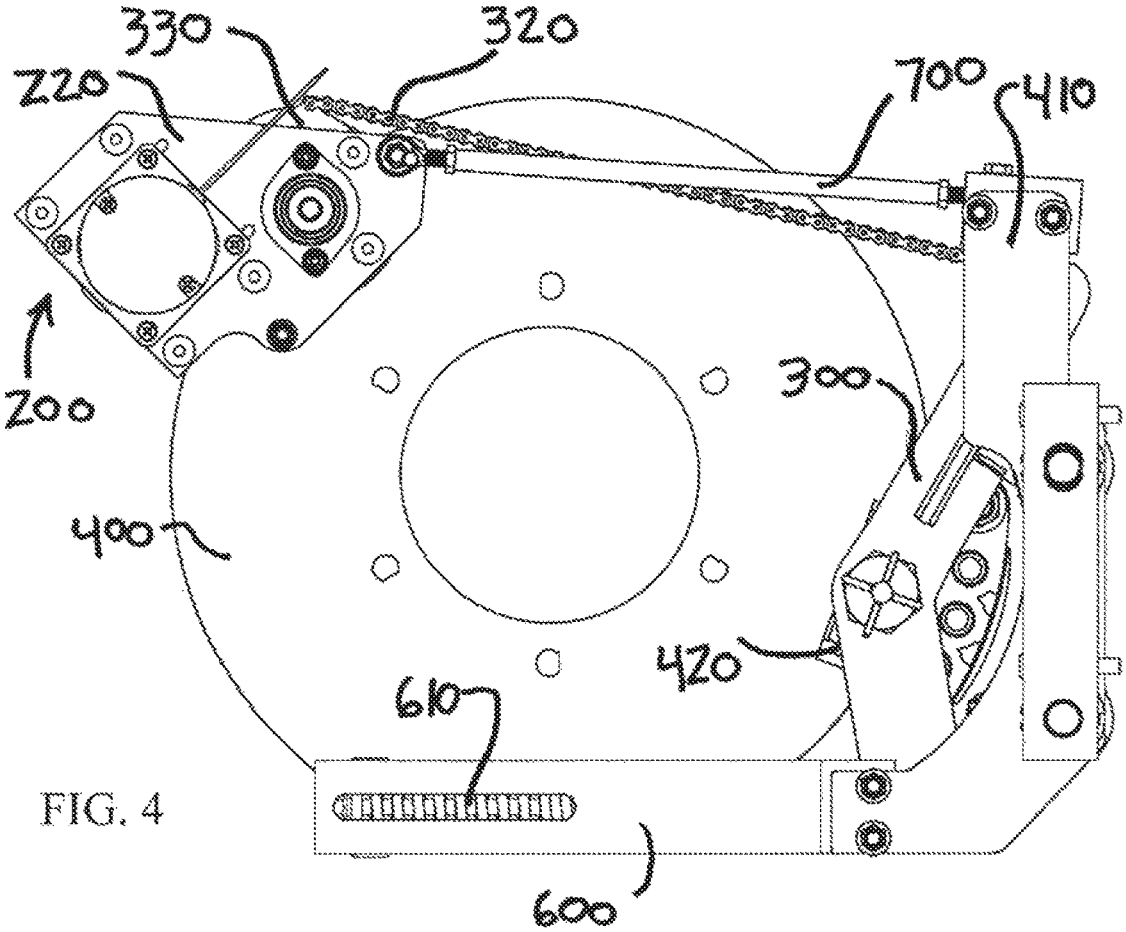
FIG. 4 is a front elevation view of the brake system of FIG. 1.
Figure 5:
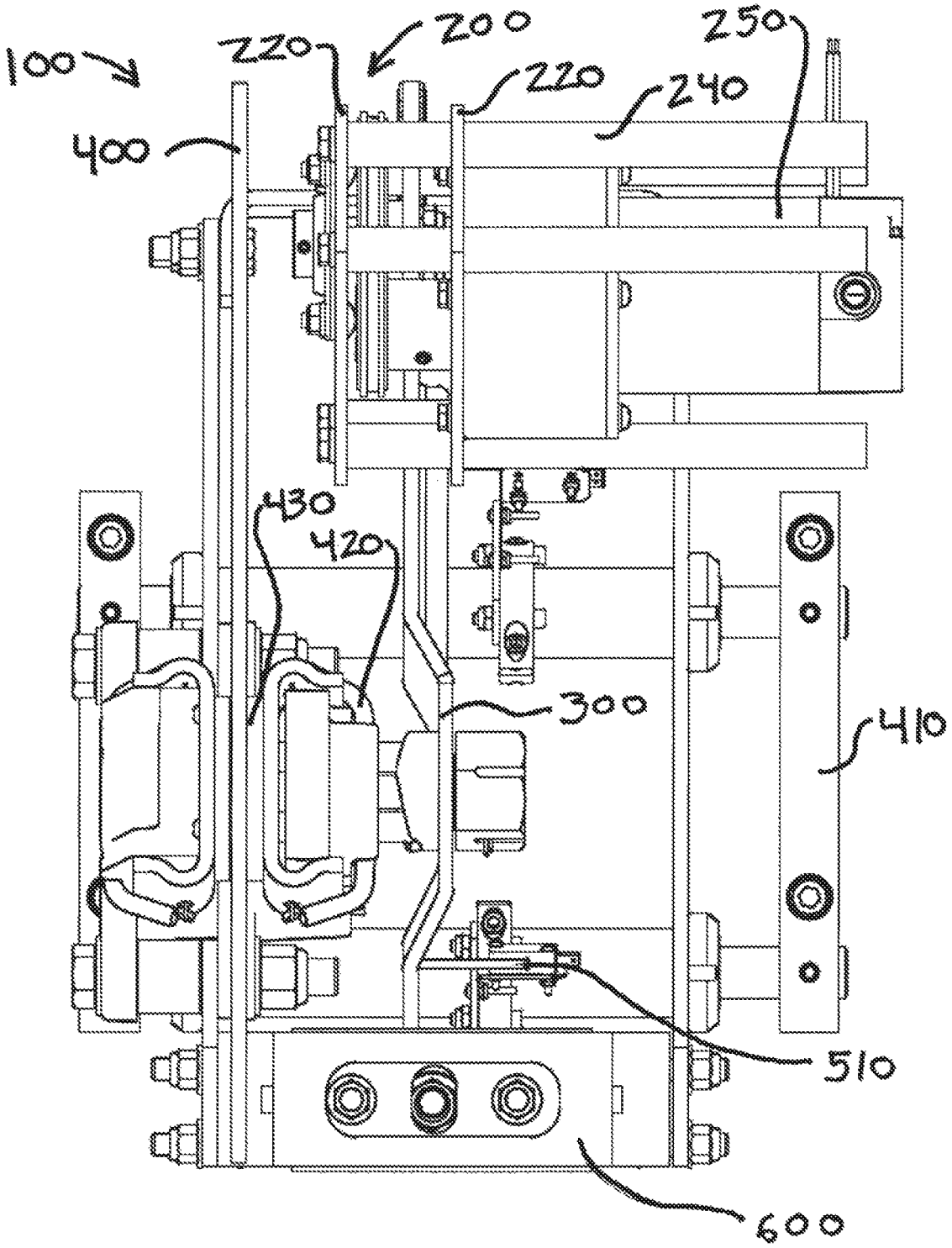
FIG. 5 is a left side elevation view of the brake system of FIG. 1.
Figure 6:
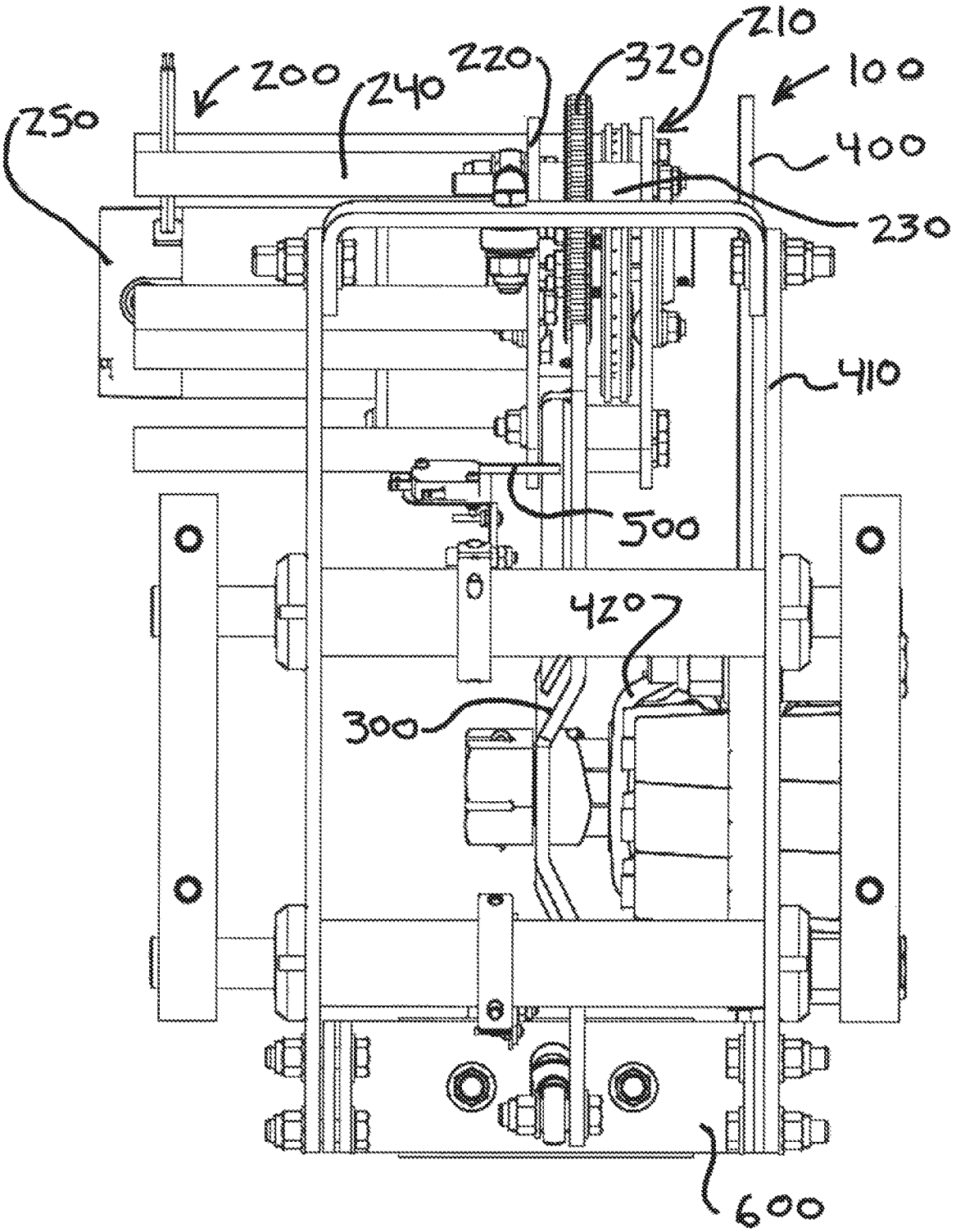
FIG. 6 is a right side elevation view of the stepladder of FIG. 1.
Figure 7:
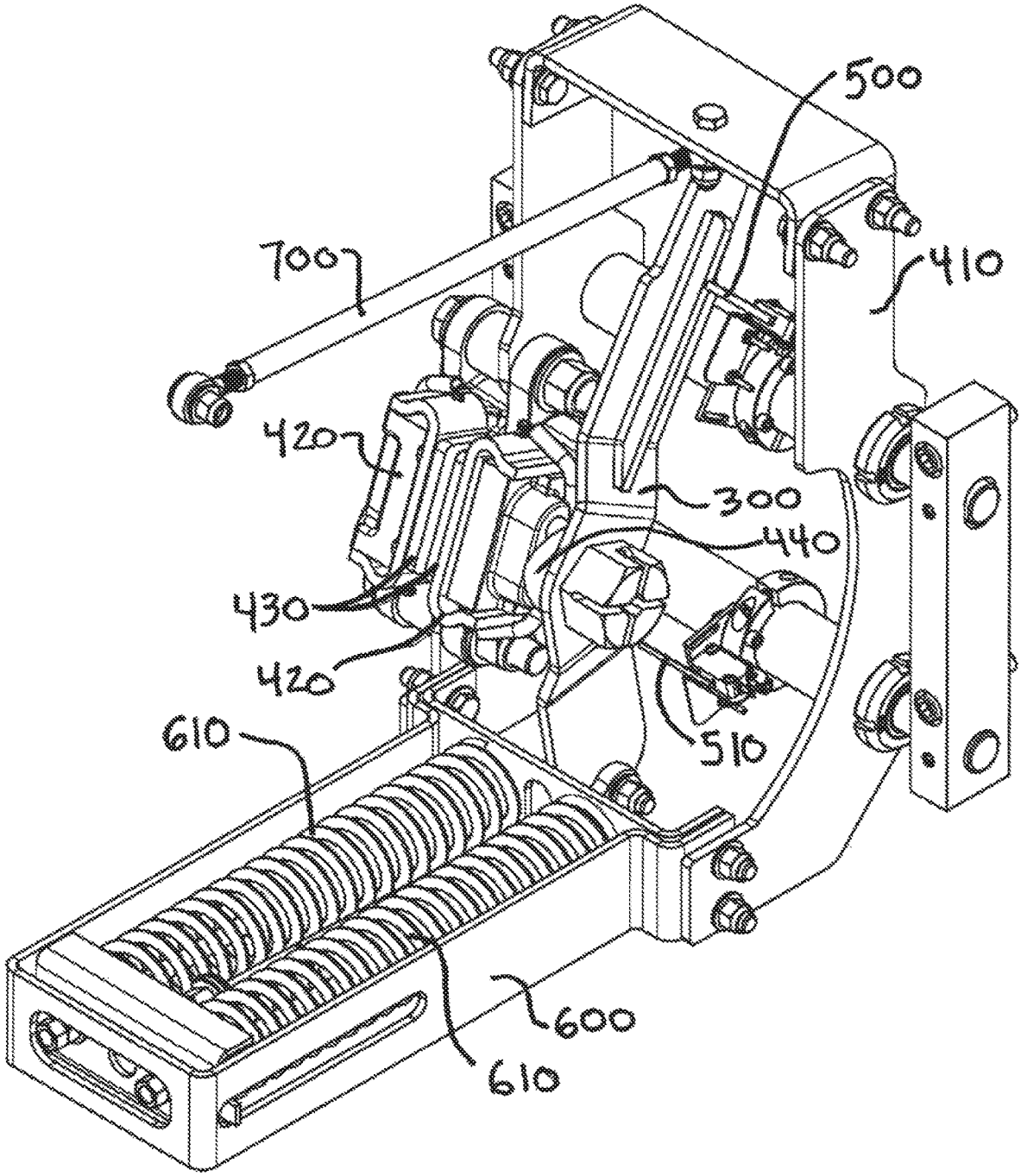
FIG. 7 is a front isometric view of brake system of FIG. 1 omitting the brake motor assembly and brake disk of the system.
Figure 8:
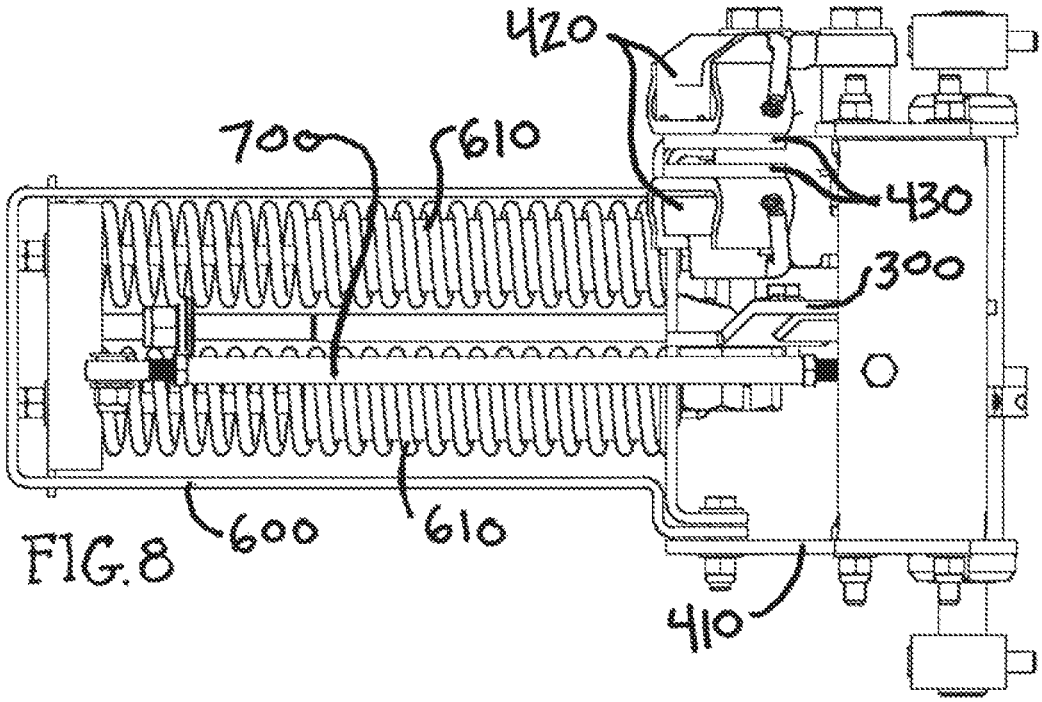
FIG. 8 is a top view of the brake system of FIG. 7.
Figure 9:
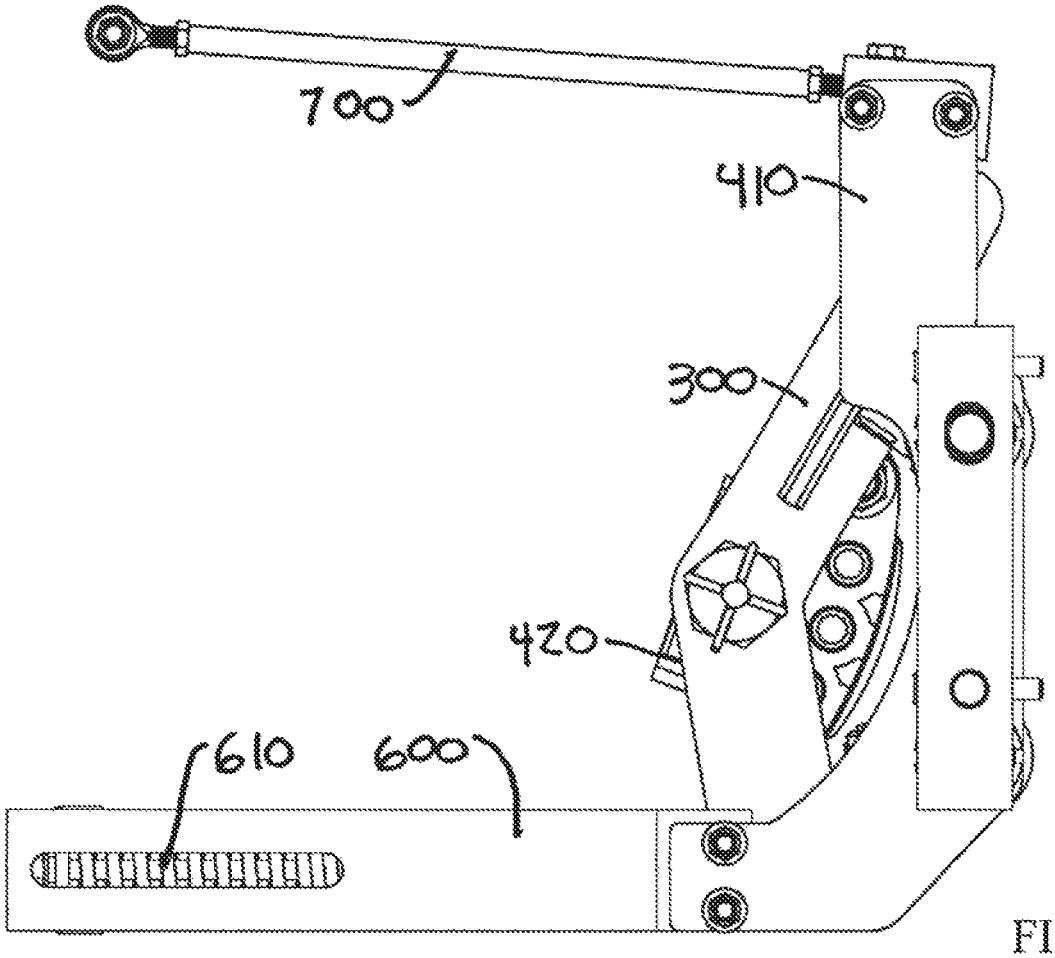
FIG. 9 is a front elevation view of the brake system of FIG. 7.
Figure 10:
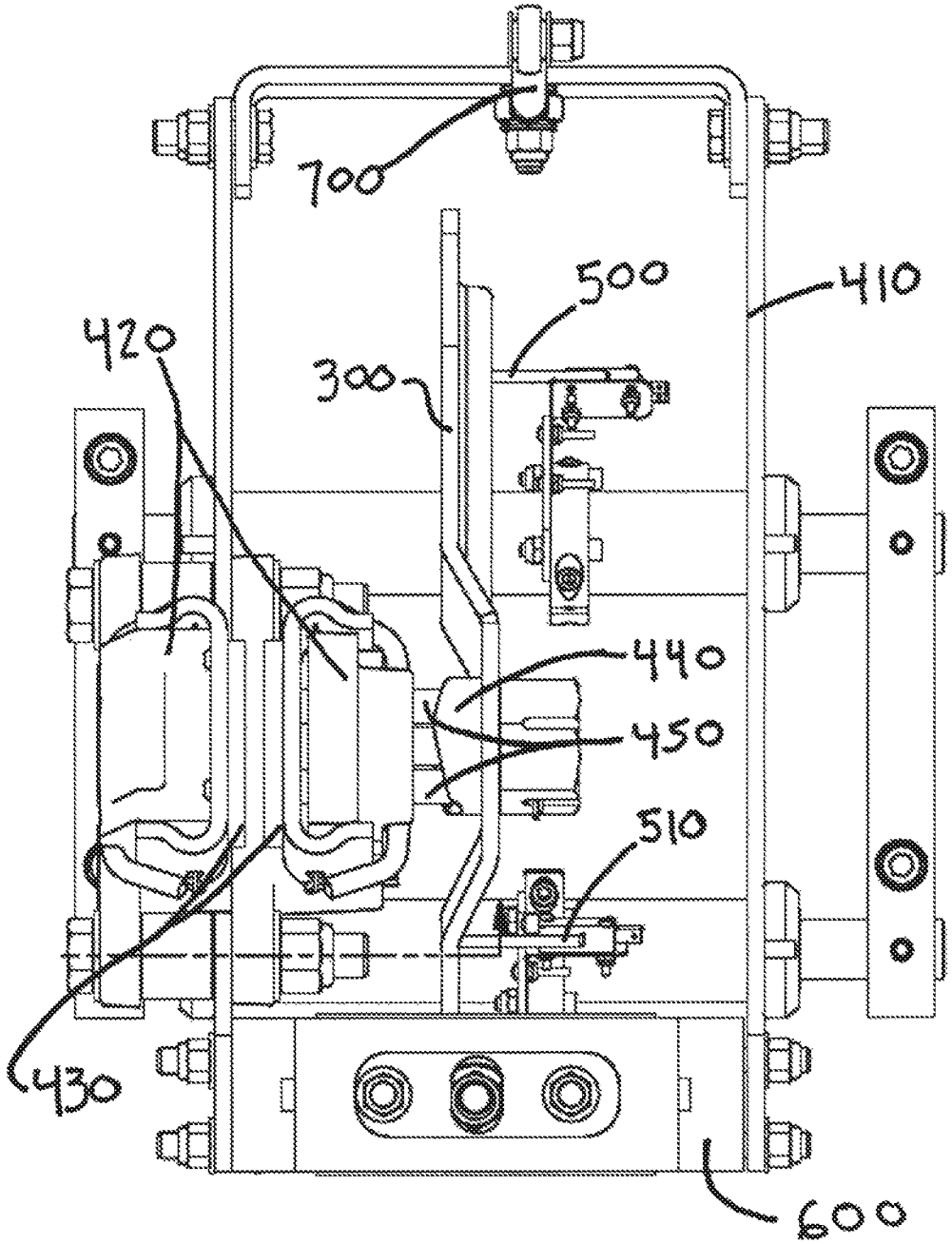
FIG. 10 is a left side elevation view brake system of FIG. 7.
Figure 11:
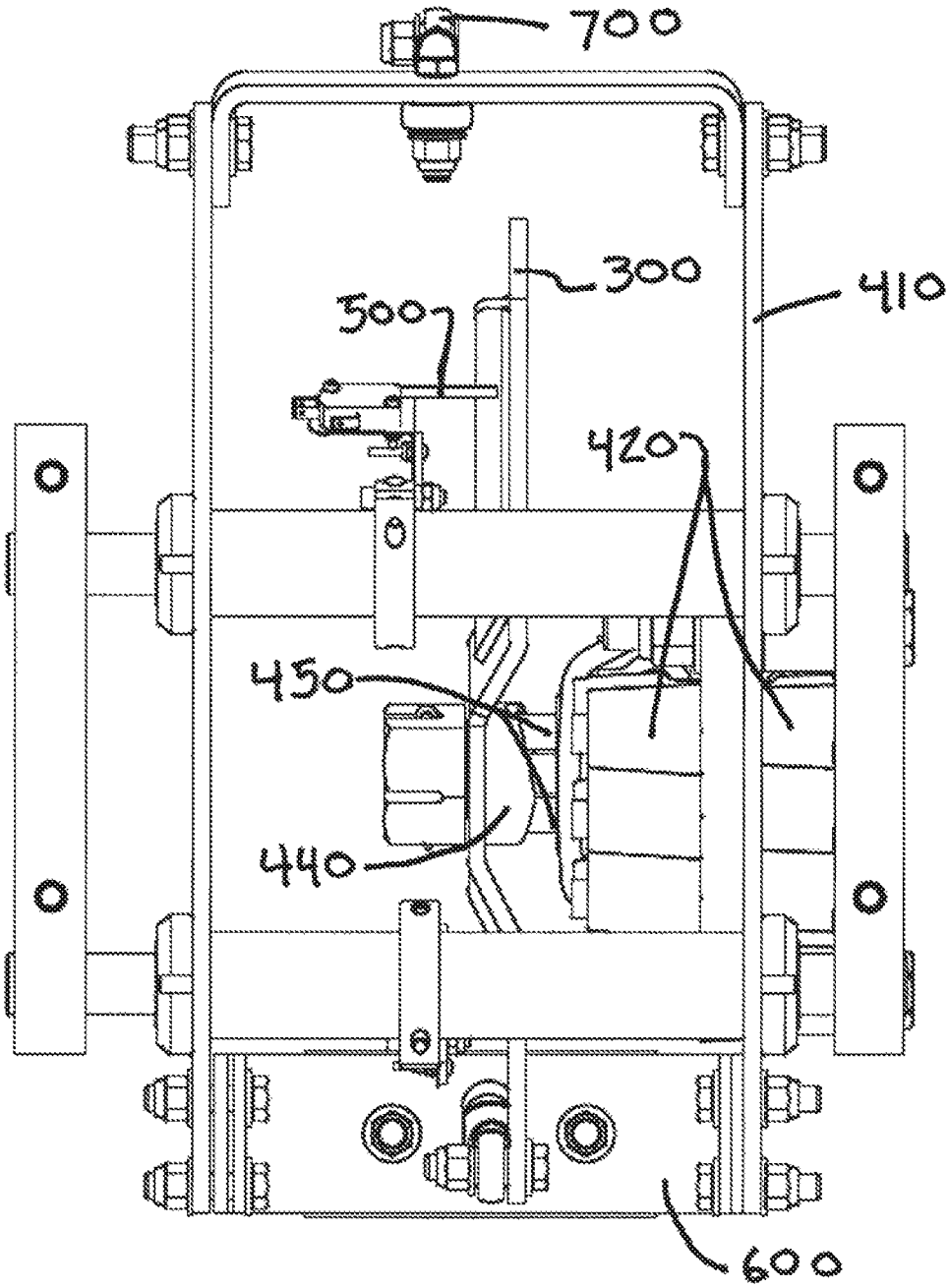
FIG. 11 is a right side elevation view brake system of FIG. 7.
Figure 12:
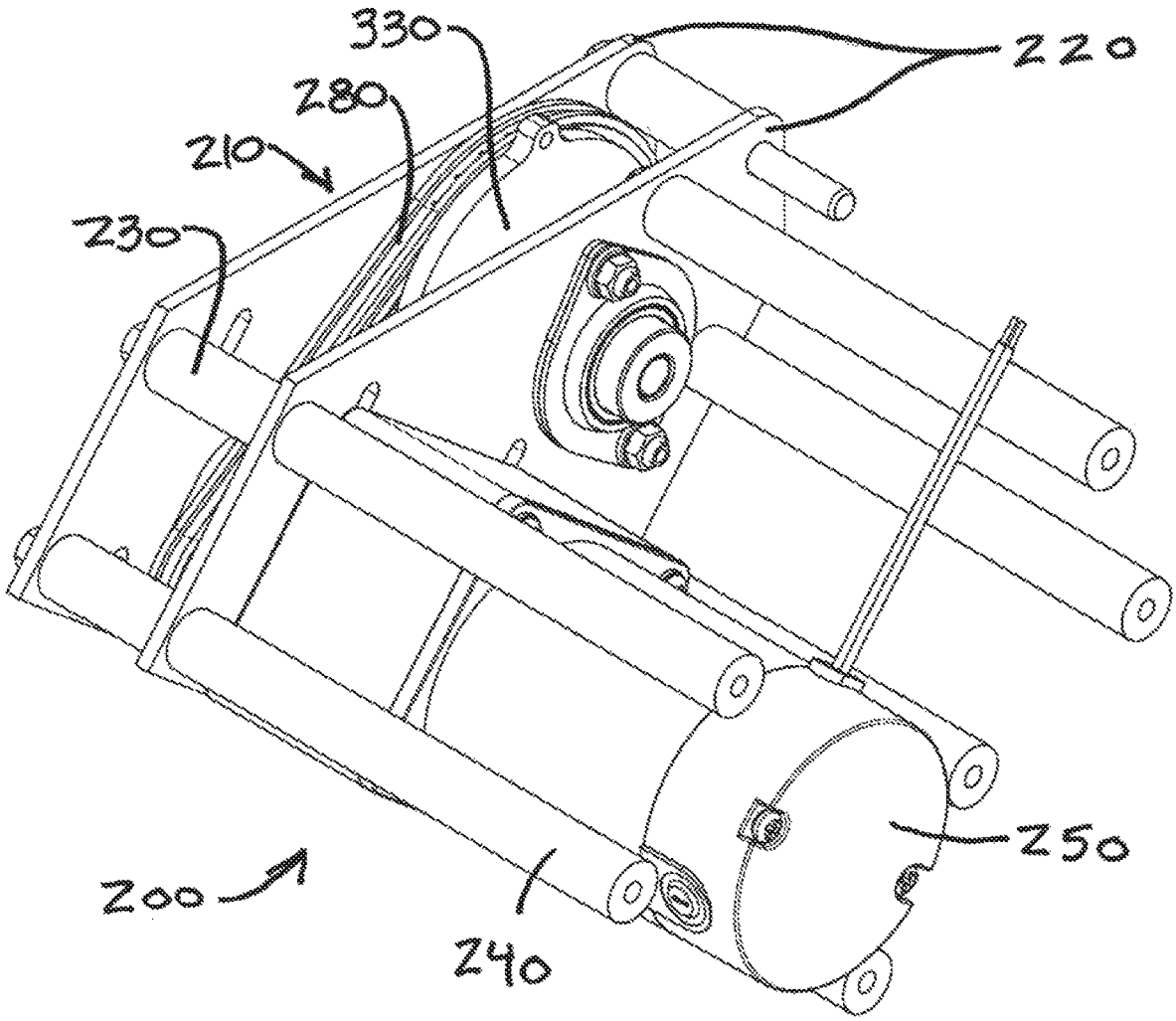
FIG. 12 is a front isometric view of the brake motor assembly of the brake system of FIG. 1.
Figure 13:
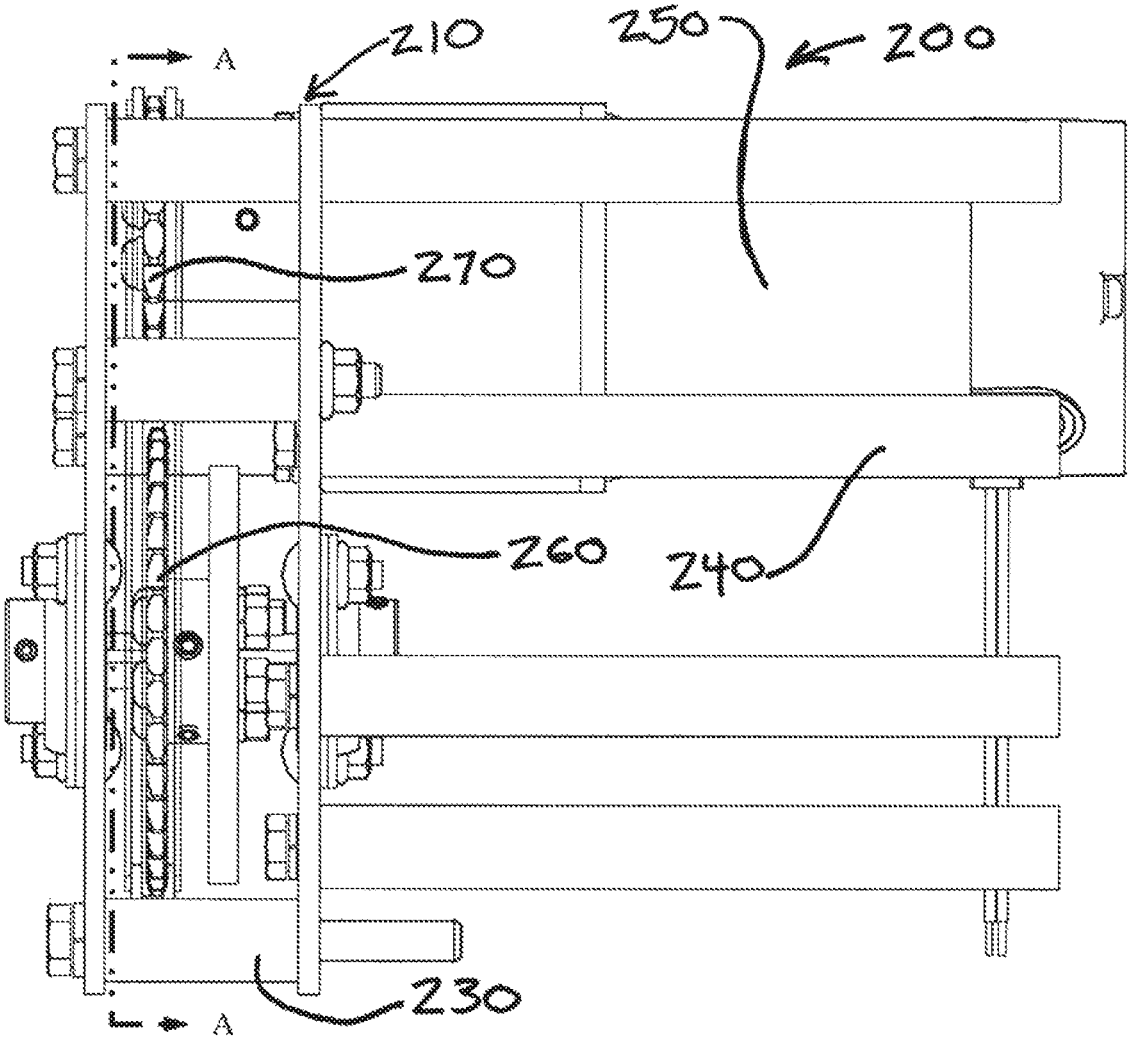
FIG. 13 is a left side elevation view of the brake motor assembly of FIG. 12.
Figure 14:
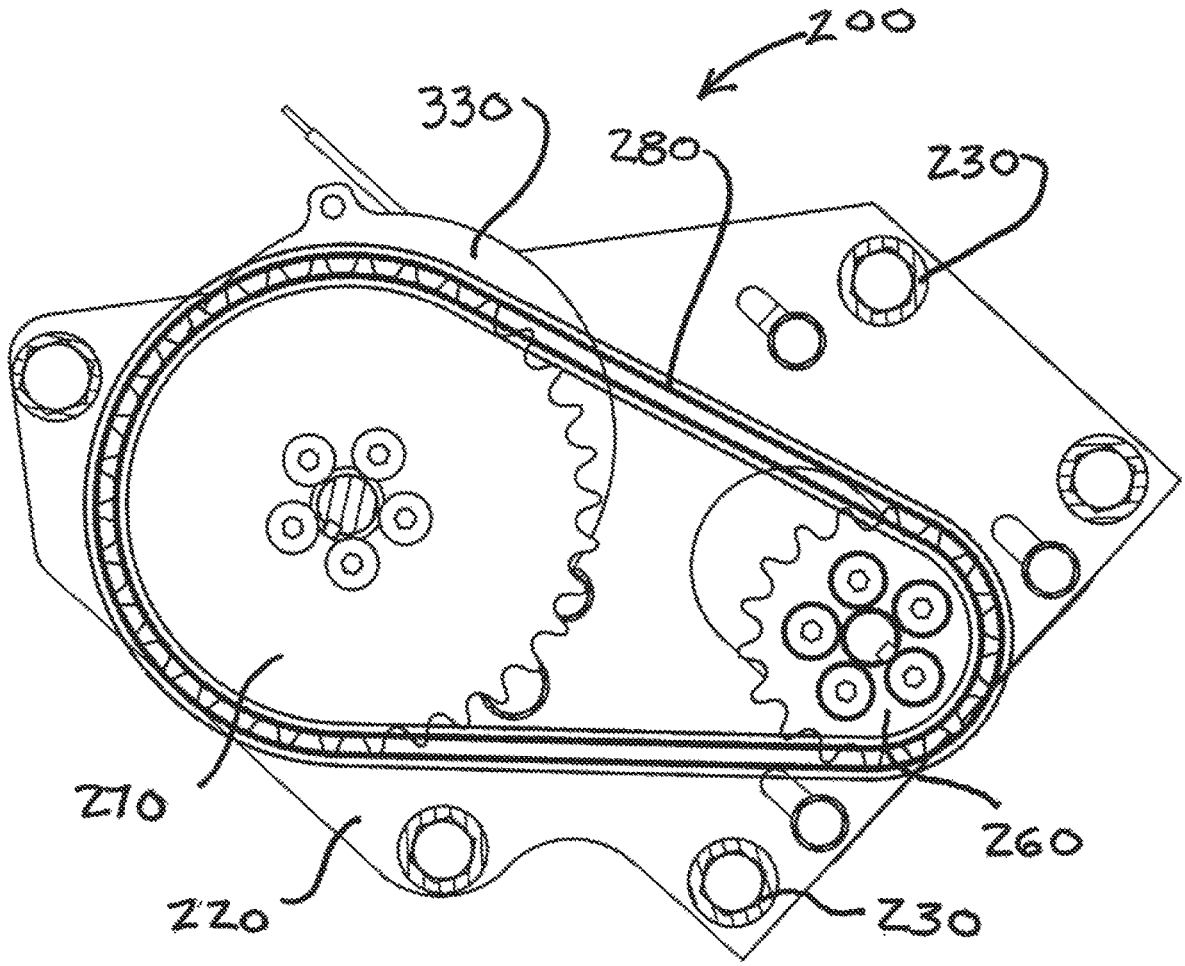
FIG. 14 is a cross sectional view of the brake motor assembly of FIG. 13 taken along line A-A.

As illustrated in FIGS. 1-2, the mechanical portion of the electro-mechanical brake system 100 is generally comprised of an actuation arm 300, a caliper 420, a brake disc 400, an electro-mechanical link 320, and a biasing member 610. The electrical portion of the electro-mechanical brake system 100 is generally comprised of a brake motor 250 and a controller 900 (FIGS. 15-18).

In a disclosed embodiment, the actuation arm 300, caliper 420, and biasing member 610 are mounted to a caliper frame 410. The preferred embodiment comprises a biasing member of one or more torsion springs, but any means of biasing the actuation arm 300 known in the art may be used. The biasing member 610 is preferably housed within a spring box 600 to support and protect the biasing member 610. The biasing member 610 is operably connected to the actuation arm 300, which is also operably connected to an electro-mechanical link 320 that connects the mechanical portion of the electro-mechanical brake system 100 to its electrical portion. Movement of the actuation arm 300 controls activation and movement of the caliper 420.

A brake motor assembly 200 houses the brake motor 250 as well as other components that convert electrical power of the brake motor 250 to mechanical force for the electro-mechanical brake system 100. The brake motor 250 is mounted in a brake motor frame 210. An embodiment of the brake motor frame 210 illustrated in FIGS. 1-6 and 12-14 is comprised of brake motor frame plates 220, brake motor frame spacers 230, and brake motor frame supports 240.

In a preferred embodiment, the brake motor assembly 200 is connected to the caliper frame 420 by a torsion bar 700. The torsion bar 700 prevents movement of the brake motor assembly 200 with respect to the caliper frame 420, allows for fine tuning and adjustment of the electro-mechanical brake system 100 to account for wear on the various system components. The torsion bar 700 is preferably threaded and adjustable at both ends to provide facilitate adjustments.

In the configuration disclosed in FIGS. 1-6 and 12-14, brake motor frame 210 not only acts to support the brake motor 250, but also supports and houses the components that apply rotation of the brake motor 250 to a link actuation cam 330. A brake drive sprocket 260 is operably connected to an axle of the brake motor 250. The brake drive sprocket 260 is operably connected via a brake drive belt 280 to a brake cam sprocket 270, which is operably connected to chain actuation cam 330. The brake drive belt 280 can be substituted with a chain other connecting means known in the art that allows transfer of rotation between the brake drive sprocket 260 and the brake cam sprocket 270. In a simplified embodiment, the brake motor 250 can be directly connected to the link actuation cam 330.

The link actuation cam 330 is connected to the mechanical portion of the electro-mechanical brake system 100 via electro-mechanical link 320. In the disclosed embodiment, the electro-mechanical link 320 is a roller chain. However, any means of transferring the movement of the link actuation cam 330 to the actuation arm 300 known in the art can be substituted for the electro-mechanical link 320. The electro-mechanical link 320 is coupled to the link actuation cam 330 by connecting and to the actuation arm 300 by connecting links 310, 290. However, any other means of connecting the electro-mechanical link 320 to the actuation arm 300 and link actuation cam 320 known in the art may be used.

Movement of the actuation arm 300 results in operation of the caliper 420. In one embodiment, the actuation arm 300 moves a caliper actuation cam 440, which in turn acts on caliper push pins 450 to move caliper pads 420 together or apart. When caliper pads 420 move together, they act to squeeze against the brake disc 400 to create friction and slow the rotation of a hoist drum 850 (FIGS. 15-16), either to reduce its rotational speed ("engaged") or to hold it stationary ("fully engaged").

Movement of the actuation arm 300 from this position allows the caliper pads 420 to release from the brake disc 400 to allow rotation of the drum 850 ("open"). The preferred embodiment utilizes the biasing member 610 to keep the actuation arm 300 in a position where the electro-mechanical brake system 100 is fully engaged (i.e., the caliper pads 420 are fully pressed against the brake disc 400. In this configuration, movement of the brake disc 400 can only occur with power to the brake motor 250 and a control signal. This arrangement allows the electro-mechanical brake system 100 to act as a fail-safe brake mechanism for a hoist system 1000 or other analogous device.

In a preferred embodiment, the maximum movement of the actuation arm 300 is restricted by a clamping position limit switch 500 and an open position limit switch 510. The clamping position limit switch 500 controls the maximum movement of the actuation arm 300 in the unbiased direction and the open position limit switch 510 controls the maximum movement of the actuation arm 300 in the biased direction.

Figure 15:
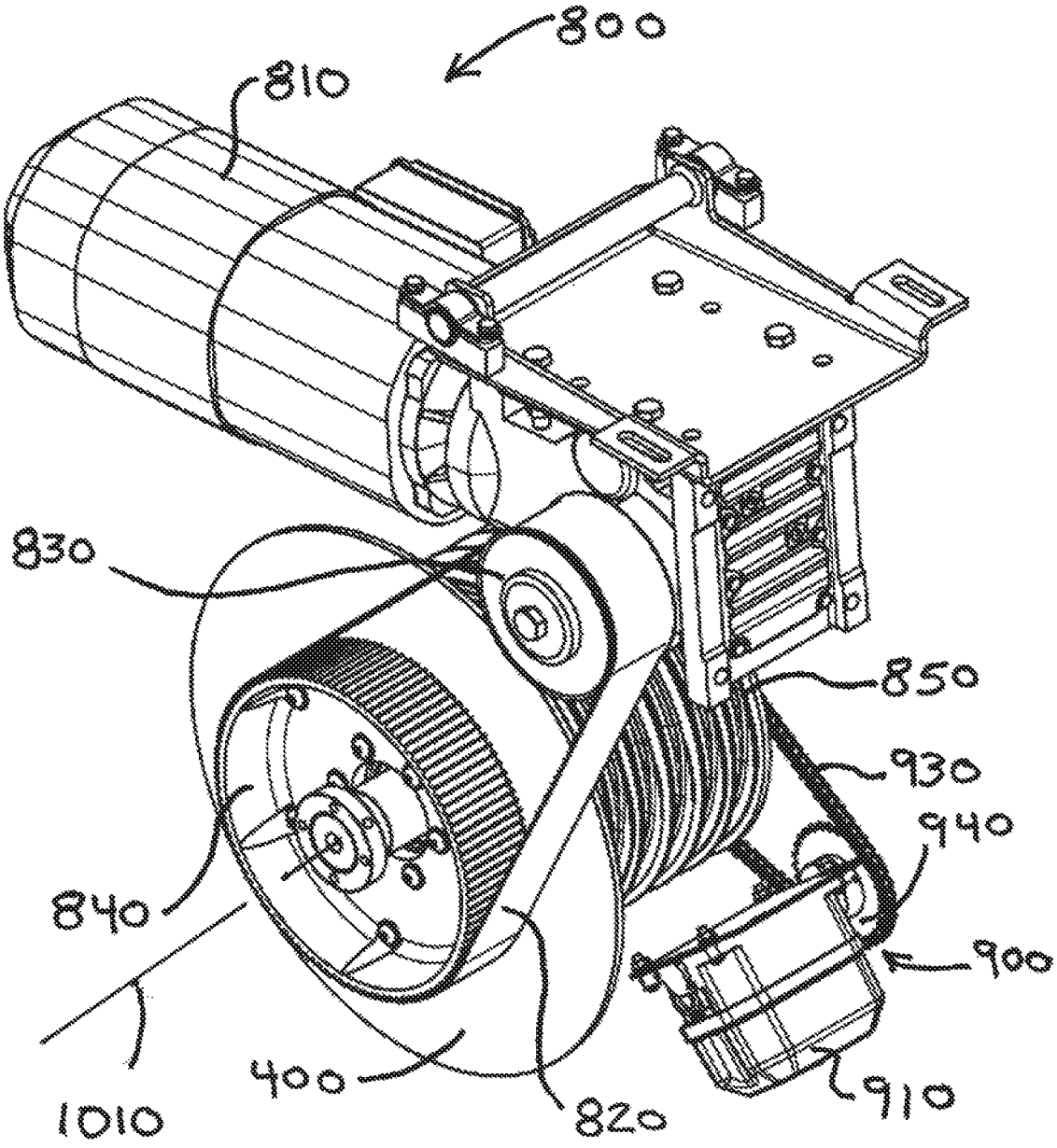
FIG. 15 is a rear isometric view of a hoist drive system incorporating an embodiment of the invention.
Figure 16:
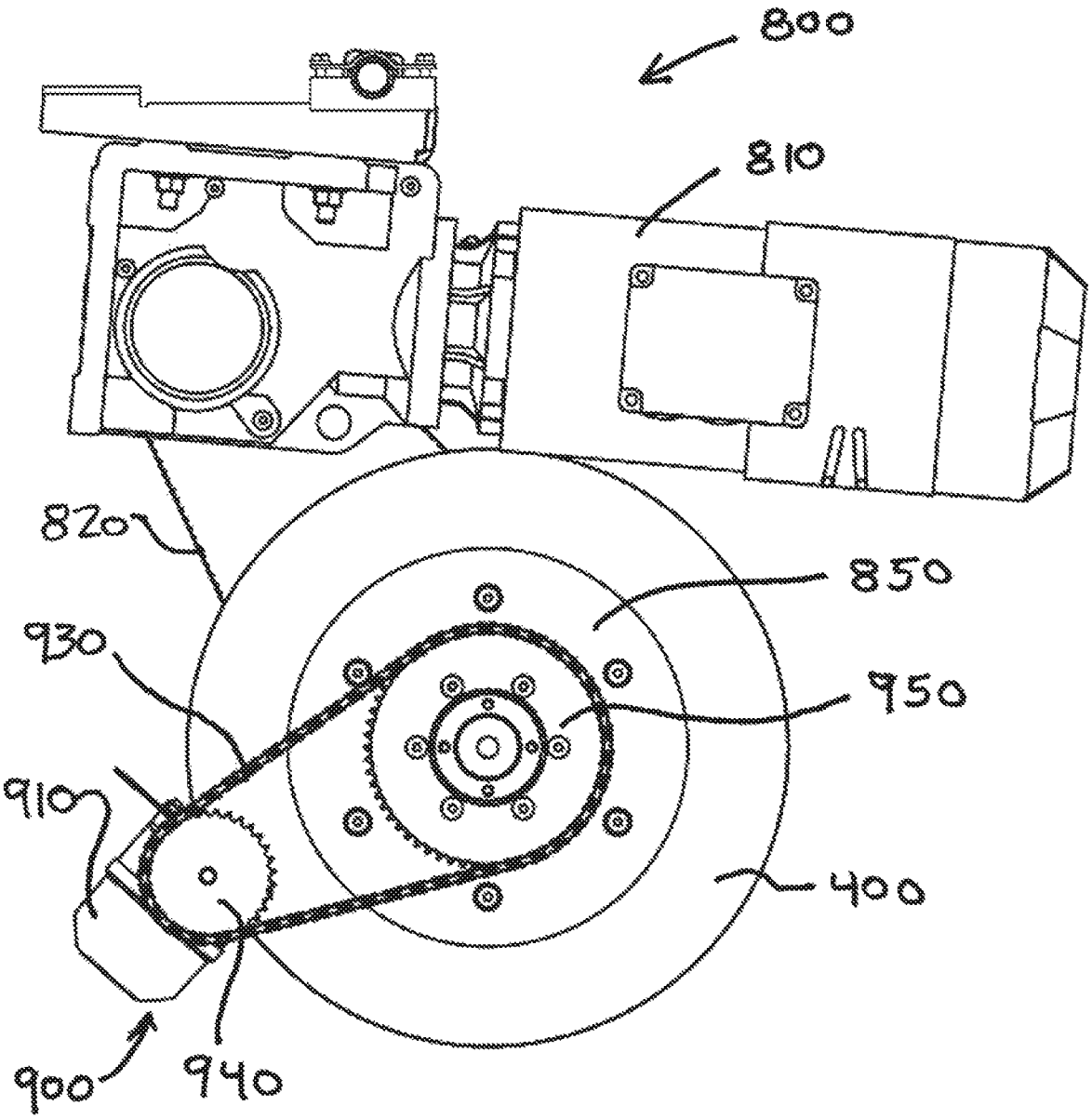
FIG. 16 is a front elevation view of the hoist drive system of FIG. 15.

FIGS. 15-16 illustrate an embodiment of a hoist drive system 800 for which the electro-mechanical brake system 100 of the present invention may be used. The hoist drum 850 of the hoist system 1000 is powered by a hoist motor 810. In one embodiment, the hoist motor 850 rotates a hoist drive pulley 830 that is mechanically coupled to a hoist drum pulley 840 via a flexible coupler 830. In the preferred embodiment, the flexible coupler 830 comprises a timing belt with teeth, but may comprise friction belts, single or multi-row roller chains, or other forms of soft media connections known in the art. The utilization of teeth on the hoist drive pulley 830, hoist drum pulley 840, and flexible coupler 830 provide for more exact rotation control and monitoring of the hoist drum 850.

The hoist drum pulley 840 is mechanically coupled to and rotates the hoist drum 850. In the illustrated embodiment, the brake disc 400 is mounted between the hoist drum 850 and the hoist drum pulley 840. This arrangement allows direct application of braking force on both the hoist motor 810 and the hoist drum 850. In the preferred embodiment, the hoist drum, brake disc 400, and drum pulley 840 all share an axis of rotation 1010. The present invention also contemplates the brake disc 400 being mounted on the opposite side of the hoist drum 850 from the hoist drum pulley 840.

Another embodiment of the invention includes a means of providing additional monitoring and control of the hoist drum 850 movement. As shown in FIGS. 15-16, the electro-mechanical brake system 100 includes a positional system monitor (or controller) 900 with integrated encoder (not shown) that monitors the rotation of the hoist drum 850 relative to the rotation of the hoist motor 810. The controller also includes a drum sprocket 950 and a limit switch sprocket 940 operably connected by a limit switch drive chain 930.

Through an algorithm in the controller 900, the encoder count is used to calculate the position of the cable travel based on the diameter growth created from the cable building up on the hoist drum 850. This system is similar to U.S. Pat. No. 8,328,165, which is incorporated herein by reference in its entirety.

By taking into account the number of cable wraps per layer, the diameter of the cable, and the diameter of each layer and accounting for the ratio difference between each encoder and the speed ratio of the hoist motor 810 and the ratio introduced by the ratio between the drum sprocket 950 and the limit switch sprocket 940, a greatly increased accuracy of monitoring and control is established.

For example, a ratio of 3,600 revolutions of a limit switch encoder per hoist drum 850 rotation can be accomplished. When the controller 900 indicates variations between the actual hoist drum 850 rotation and expected values from the hoist motor 810 rotation outside of acceptable limits, the controller 900 can shut down the hoist motor 810. This feature acts as an additional fail-safe to that provided by the electro-mechanical brake system 100.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. A hoist system comprising:
- a hoist drum;
- a brake disc;
- a brake system comprising:
  - a brake motor assembly including a brake motor, a brake drive sprocket, a brake cam sprocket, and a brake drive belt;
  - a brake actuation arm having an engaged position and an open position;
  - a link operably connecting the brake motor assembly to the brake actuation arm;
  - a brake caliper operably connected to the brake actuation arm; and
  - a brake biasing member;
- wherein the brake disc is positioned to be selectively acted upon by the brake caliper and the brake biasing member biases the brake actuation arm to an engaged position.

2. The hoist system of claim 1 wherein the brake caliper comprises:
- a caliper pad;
- a caliper actuation cam; and
- a caliper push pin.

3. The hoist system of claim 2 wherein the activation of the brake motor causes the brake actuation arm to move from an engaged position to an open position.

4. The hoist system of claim 3 further comprising:
- a clamping position limit switch that controls the maximum movement of the brake actuation arm in an engaged position; and
- an open position limit switch that controls the maximum movement of the brake actuation are in the open position.

5. The hoist system of claim 1 wherein the biasing member comprises a spring.

6. The hoist system of claim 1 further comprising a hoist drum pulley wherein the brake disc is between the hoist drum pulley and the hoist drum.

7. The hoist system of claim 6 wherein the brake disc, hoist drum pulley, and hoist drum share an axis of rotation.

8. A hoist system comprising:
- a hoist drum;
- a brake disc;
- a brake system comprising:
  - a brake motor assembly;
  - a brake actuation arm having an engaged position and an open position;
  - a link operably connecting the brake motor assembly to the brake actuation arm;

a brake caliper operably connected to the brake actuation arm; and a brake biasing member;

a controller;

a rotary limit switch;

an integrated encoder;

a limit switch sprocket;

a drum sprocket; and a limit switch drive chain;

wherein the brake disc is positioned to be selectively acted upon by the brake caliper and the brake biasing member biases the brake actuation arm to an engaged position.

9. The hoist system of claim 8 further comprising a hoist motor and wherein the integrated encoder rotates at least 3,000 times per revolution of the hoist drum.

10. A hoist system comprising:

a hoist drum;

a hoist drum pulley;

a brake disc;

a brake system comprising:

a brake motor assembly comprising:

a brake motor;

a brake drive sprocket;

a brake cam sprocket; and a brake drive belt;

a brake actuation arm having an engaged position and an open position;

a link operably connecting the brake motor assembly to the brake actuation arm;

a brake caliper operably connected to the brake actuation arm, the brake caliper comprising:

a caliper pad;

a caliper actuation cam; and a caliper push pin; and a brake biasing member;

wherein the brake disc is positioned to be selectively acted upon by the brake caliper and the brake biasing member biases the brake actuation arm to an engaged position.

11. The hoist system of claim 10 further comprising:

a clamping position limit switch that controls the maximum movement of the brake actuation arm in an engaged position; and an open position limit switch that controls the maximum movement of the brake actuation are in the open position.

12. The hoist system of claim 11 further wherein the brake disc is between the hoist drum pulley and the hoist drum and further wherein brake disc, hoist drum pulley, and hoist drum share an axis of rotation.

13. The hoist system of claim 12 wherein the biasing member comprises a spring.

14. The hoist system of claim 12 further comprising:

a controller;

a rotary limit switch;

an integrated encoder;

a limit switch sprocket;

a drum sprocket; and a limit switch drive chain.

15. The hoist system of claim 12 further comprising a hoist motor and an integrated encoder, and wherein the integrated encoder rotates at least 2,400 times per revolution of the hoist drum.

16. The hoist system of claim 11 wherein the activation of the brake motor causes the brake actuation arm to move from an engaged position to an open position.

17. A hoist system comprising:

a hoist drum;

a brake disc;

a controller;

a rotary limit switch;

an integrated encoder;

a limit switch sprocket;

a drum sprocket;

a limit switch drive chain;

a brake system comprising:

a brake motor assembly;

a brake actuation arm having an engaged position and an open position;

a link operably connecting the brake motor assembly to the brake actuation arm;

a brake caliper operably connected to the brake actuation arm; and a brake biasing member;

wherein the brake disc is positioned to be selectively acted upon by the brake caliper and the brake biasing member biases the brake actuation arm to an engaged position.

18. The hoist system of claim 17 further comprising a hoist motor and wherein the integrated encoder rotates at least 2,400 times per revolution of the hoist drum.

19. The hoist system of claim 17 wherein the brake motor assembly comprises a brake motor and wherein the activation of the brake motor causes the brake actuation arm to move from an engaged position to an open position.

* * * * *